United States Patent [19]

Huard

[11] Patent Number: 4,923,337

[45] Date of Patent: May 8, 1990

[54] PRESTRESSED STEEL TUBE, IN PARTICULAR FOR MAKING ANCHOR LINES FOR TAUT LINE TYPE PRODUCTION PLATFORMS, A METHOD OF HANDLING AND INSTALLING SUCH A TUBE, AND A PLATFORM INCLUDING SUCH A TUBE

[75] Inventor: Gilbert Huard, Rueil Malmaison, France

[73] Assignee: Bouyguess Offshore, Montigny-le-Bretonneux, France

[21] Appl. No.: 178,470

[22] Filed: Apr. 7, 1988

[30] Foreign Application Priority Data

Apr. 10, 1987 [FR] France ..... 87 05115

[51] Int. Cl.[5] ..... B63B 35/44; B63B 21/50; D07B 1/00; E02D 29/06

[52] U.S. Cl. ..... 405/224; 405/195; 114/264; 114/294; 52/230

[58] Field of Search ..... 405/195, 224; 52/223 L, 52/225, 227, 230; 114/265, 264, 294

[56] References Cited

U.S. PATENT DOCUMENTS

| | | | |
|---|---|---|---|
| 3,378,965 | 4/1968 | Broquist | 52/230 X |
| 3,709,182 | 1/1973 | Horton | 114/294 |
| 4,297,965 | 11/1981 | Horton et al. | 114/265 |
| 4,398,377 | 8/1983 | Romig | 52/230 X |
| 4,521,135 | 6/1985 | Silcox | 405/224 |
| 4,592,181 | 6/1986 | Matt | 52/223 L |
| 4,630,970 | 12/1986 | Gunderson et al. | 405/224 |
| 4,768,455 | 9/1988 | Maxson et al. | 114/264 |

FOREIGN PATENT DOCUMENTS

| | | | |
|---|---|---|---|
| 191992 | 8/1986 | European Pat. Off. . | |
| 2484355 | 12/1981 | France . | |
| 2535281 | 5/1984 | France . | |
| 2554780 | 5/1985 | France . | |
| 162930 | 5/1964 | U.S.S.R. | 52/230 |
| 2085939 | 5/1982 | United Kingdom . | |

*Primary Examiner*—Dennis L. Taylor
*Assistant Examiner*—John Ricci

[57] ABSTRACT

According to the invention a steel tube is prestressed longitudinally. This prestress is advantageously exerted by cables (20) extending along the tube (10) either inside the tube or outside the tube, and prevented from moving transversely relative to the tube, said cables being constituted by fibers (of glass, of carbon, or of other inorganic materials), having a breaking strength which is greater than that of steel. Such a structure is particularly applicable to anchoring a taut line type oil production platform (200) at sea. In this case, the advantages of inorganic fibers and of steel are combined, thereby taking advantage of the very high breaking strength in traction of the fibers in order to prestress the steel which can then be subjected to much lower stress than the fibers, thus considerably reducing the elongation of the anchor lines.

8 Claims, 3 Drawing Sheets

PRESTRESSED STEEL TUBE, IN PARTICULAR FOR MAKING ANCHOR LINES FOR TAUT LINE TYPE PRODUCTION PLATFORMS, A METHOD OF HANDLING AND INSTALLING SUCH A TUBE, AND A PLATFORM INCLUDING SUCH A TUBE

The present invention relates to a steel tube for constituting a line which is subjected in operation to tension exerted from opposite thrust points, and in particular for constituting an anchor line for a taut line type of production platform at sea. The invention also relates to a method of handling and installing such a tube.

BACKGROUND OF THE INVENTION

This type of platform which can be used for drilling or production in deep seas is a floating platform which is fixed to the sea bed by means of lines which are connected to bases or anchor ballast disposed on the sea bed. Anchor lines are generally made of bundles of steel cables or tubes, and are provided at each end with a flexible or hinged connector enabling them to operate continuously under tension, with very low bending couples in spite of the forces to which the floating platform is subjected and which are transmitted to the lines.

One such type of taut line platform and a method of positioning it are described, in particular, in French Pat. No. 2 554 780.

An anchor line constituted by a sequence of tubular lengths of steel each individually longitudinally prestressed by an internal cable and assembled to one another by threaded portions is described in European patent publication EP-A-O 191 992.

In such an anchor line, the screwed threaded portions of the lengths are not prestressed and the initially prestressed portions of the lengths are stressed only to a compression force which is less than the in-service tension of the line.

The invention seeks to mitigate this drawback.

SUMMARY OF THE INVENTION

This is achieved, according to the invention, by a steel tube for constituting a line which is subjected in service to tension exerted between opposite thrust points, said tube being constituted by a sequence of lengths of steel which are longitudinally prestressed by a bundle of cables and being terminated at each end by a thrust connector, wherein the bundle of prestress cables is common to the entire set of lengths and the prestress is adjusted to a value which is greater than the value of said tension such that in operation the tube between the thrust points is maintained under compression.

The invention thus makes it possible for the steel to work in compression all the time and no longer in traction, thereby providing good fatigue performance.

The cables may be made, in particular, of glass fibers, carbon fibers, or fibers of other inorganic substances.

In organic fibers such as glass fibers and carbon fibers have a breaking strength in traction which is much greater than that of ordinary steel, generally being about 3,000 MPa, i.e. they are about seven times stronger than steel.

However, such fibers cannot be used on their own for anchoring taut line platforms, because of the considerable variations in elongation under the effect of swells. As a general rule their modulus of elasticity is lower than that of steel, and in any event is never greater than that of steel.

The principle of the invention thus makes it possible to combine the respective advantages of inorganic fibers and of steels, thus taking advantage of the very high breaking strength of fibers in traction for prestressing the steel which can then be subjected to much lower stress than the fibers, thus considerably reducing the elongation of the anchor lines.

The prior art (British patent publication GB-A 2 085 939) also includes an anchor line constituted by a sequence of tubular lengths of common longitudinal prestressed cable. But, unlike the present invention, the in-service tension is exerted on the common cable, and the modulus of elasticity of the lengths must be less than that of the cable. That is why this prior art uses lengths made of concrete.

In a first embodiment, the cables are locked by a resin coating the fibers.

In a second embodiment, the cables are locked by mechanical centering devices.

If it is to be used under water, the tube forms a hermetically sealed volume with the outside diameter of the steel tube being preferably chosen in such a manner that the apparent weight of the tube in water is substantially zero.

In a preferred embodiment, the tube is consisted by lengths which are held together end to end by said prestress.

Thus, the fibers constitute a means for assembling the tube when the tube is constituted by lengths disposed end-to-end, thereby avoiding mechanical assembly means or welding, which are always difficult to provide at sea.

The invention also relates to a method of handling and installing such a tube constituted by lengths which are held together and assembled by prestress, said method being applied to constituting an anchor line for a taut line production platform at sea.

According to the invention, the method comprises the following steps:

- preassembling, on land, the lengths of tube which are interconnected by the cables under no tension, together with the bottom connector component and the top connector component, and then winding said assembly on a handling drum having a polygonal contour whose side is substantially equal in length to the length of each length of tube;
- unwinding the assembly into the anchor well of the platform;
- applying a tension to the cables so as to prestress the tube;
- connecting the bottom connector component to a base placed at the bottom of the sea; and
- putting the tube under tension by conventional tensioning methods and connecting the top connector component to the platform.

BRIEF DESCRIPTION OF THE DRAWINGS

An embodiment of the invention is described by way of example with reference to the accompanying drawings, in which.

MORE DETAILED DESCRIPTION

Figure 2:
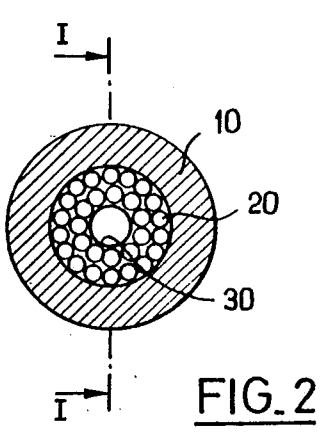
FIG. 2 is a cross-section through the same tube on a line II—II of FIG. 1.
Figure 1:
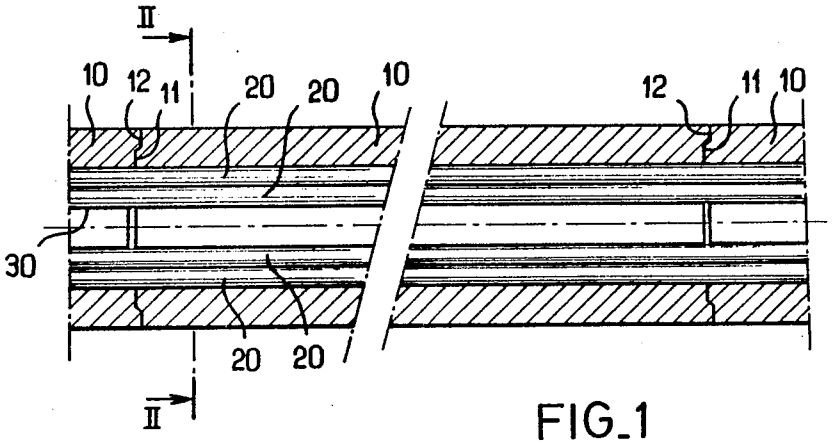
FIG. 1 is a longitudinal section on line I—I of FIG. 2 through a first embodiment of a tube in accordance with the invention.

In the embodiment of FIGS. 1 and 2, the tube is constituted by thick small diameter components.

The ends of the steel tubular components 10 are provided with matching shoulders 11 and 12 which are machined to provide automatic centering, good contact, and good alignment.

In addition, if perfect watertightness is required under high water pressure, a suitable glue or resin or even a metal sealing ring may also be provided.

These various components are held in position and are prestressed by means of prestress cables 20 constituted by resin-coated inorganic fibers.

In order to ensure that the prestressed cables are accurately positioned and maintained so as to prevent any relative transverse movement between the fibers and the steel, and so as to ensure axial prestressing, they are placed so as to touch one another (see FIG. 2) and they are held in this position by means of a central concentric tube 30 which is not prestressed and which is made of steel or of a synthetic material.

The bundle of touching cables may additionally be optionally embedded in a suitable coating resin.

Figure 4:
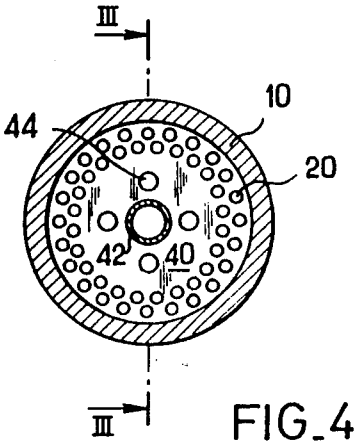
FIG. 4 is a cross-section through the same tube on a line IV—IV of FIG. 3.
Figure 3:
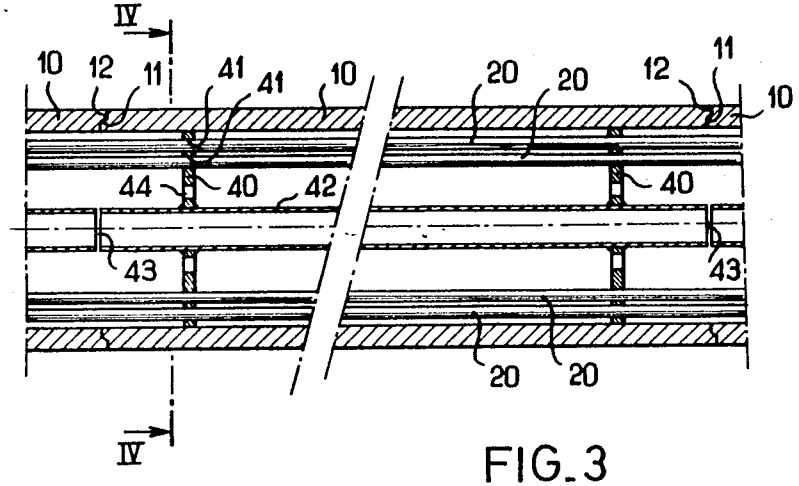
FIG. 3 is a longitudinal section on a line III—III of FIG. 4 through a second embodiment of a tube in accordance with the invention.

In the embodiment of FIGS. 3 and 4, the tube is made up of thin, large diameter components.

The steel components 10 are assembled in the same manner as in the preceding embodiment; only their dimensions are different.

Because of the much greater internal volume, the prestressed cables 20 no longer touch one another, but are maintained in position by means of a guide device constituted, for each length of tube, by two disks 40 which are perforated at 41 to pass and to hold in place the prestress cables 20.

These two disks 40 are connected to each other and are held in place by a central tube 42 which is not prestressed, and which is made of steel or a synthetic material. The disks are fixed to said central tube 42.

The guide device (disk 40 and central tube 42) slides with little clearance inside the steel tubular component 10, with a gap being provided at 43 between successive guide devices so as to make it possible to absorb the various forces to which the tube will be subjected without transmitting stress.

Finally, perforations 44 are provided for putting the volumes situated between two successive disks into communication with each other, for example, to make it possible to empty the entire inside volume of the cable.

Figure 5:
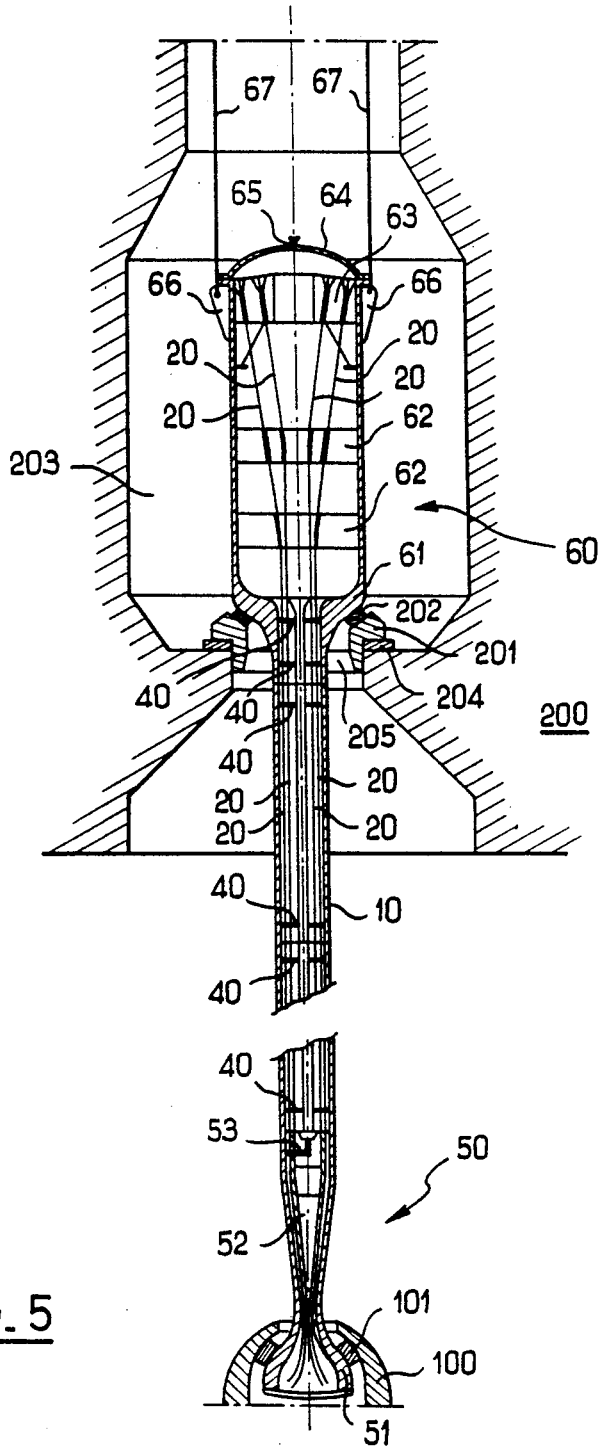
FIG. 5 shows an assembly formed by the tube and its bottom and top connectors connecting the floating platform to a foundation prepared on the sea bed.
Figure 6:
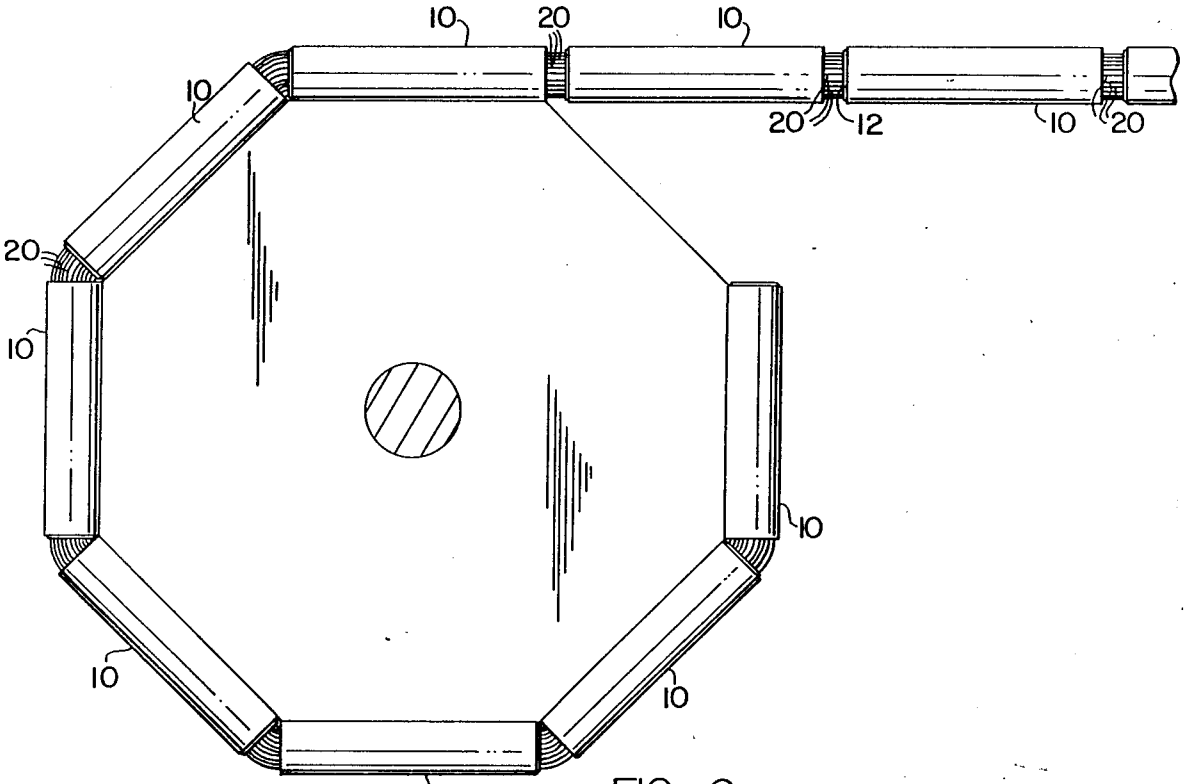

FIG. 5 shows an application of such a tube to a taut line production platform at sea.

Tubes in accordance with the invention are very advantageously used whenever there are problems of considerable elongation, at a long natural period, or where metal fatigue problems are critical when conventional steel systems are used.

This applies in particular to the anchor lines for taut line type production platforms at sea.

In this case, it is preferable to use a tube corresponding to the embodiment shown in FIGS. 3 and 4.

The diameters of the steel components can then be selected in such a manner as to ensure that the apparent weight of the prestressed steel tube when in water is practically zero, after the water contained inside said components has been removed.

In FIG. 5, the tube 10 is provided at its bottom end with a connector 50 which terminates with a hemispherical end piece 51 received in a member 100 which is fixed to the anchor foundation.

The connection between the bottom connector 50 and said member 100 is in the form of a ball joint allowing tension forces to be transmitted from the line to the foundation, and suitable for giving rise to bending couples which are very small. This is achieved by means of laminated neoprene blocks 101 or by hemispherical bearing surfaces made of graphite bronze.

The fiber prestressed cables are embedded in resin 52 inside the component 50.

Finally, a drainage tube 53 is provided with a non-return valve at the top of said component 50 and in communication with the inside volume of the prestress tube 10.

At its top end, the tube is provided with a prestress box 60 connected to the floating platform 200.

This prestress box comprises a component 61 made of cast steel and forming the bottom of the box and the male portion of the ball fastening system of the platform. This part bears against a ring 201 made of cast steel via blocks 202 of laminated neoprene or via hemispherical bearing surfaces made of graphite bronze so as to minimize the transmission of bending couples, as for the bottom connector.

Spreaders 62 cause the prestress cables to diverge on leaving the steel tube and they direct them to an anchor ring 63 where they are fixed in conventional manner by conical wedges and injected resin. The operating tension of the prestress cables is permanently monitored by monitoring means so as to keep track of their behavior.

The box 60 is closed by a sealed lid 64 provided with a connection 65 to which a flexible hose is connected for emptying the tube 10 by flushing out with air or nitrogen, with water then being ejected via the drain tube and the non-return valve 53 of the bottom connector.

The emptying device could even remain permanently connected for emptying leaks which may occur in operation, or for putting the tube under pressure in order to verify its watertightness.

Finally, the box 60 has a set of lugs 66 for connection to devices 67 for handling the tube and putting it under tension.

The prestress box is installed inside a well 203 which is enlarged where it contains the box in order to allow it to rock. The well may be under air pressure during installation and maintenance so that the prestress box and the supporting device are out of the water.

The ring 201 for supporting the ball joint bears against the bottom of the well via a system of adjustable wedges 204. The diameter of the opening 205 at the bottom of the well should be sufficient to allow the bottom connector 50 to pass therethrough, together with possible anodes and floats.

For each of its legs, the platform may comprise an anchor line constituted by seven to eight tubes made in this way and installed as described.

I claim:

1. A method of handling and installing a mooring cable assembly between a platform at sea and a base fixed at the bottom of the sea, said method comprising the following steps:

pre-assembling, on land, lengths of tube so as to provide an elongated tubular assembly of constant cross-sectional configuration throughout its length and, providing cable connection means at opposed ends of the tubular assembly, winding said assembly on a handling drum having a polygonal contour whose sides are substantially equal to the lengths of each tube of said tubular assembly, providing fibrous tensile elements the full length of said tubular assembly in unstressed condition so as to permit said winding step, unwinding said tubular assembly into an anchor well of the platform, applying tension to the fibrous tensile elements and correspondingly by compressing the tubular assembly so as to prestress the structure, securing one cable connection means to the platform and securing the cable connection means at the opposite end to a base at the bottom of the sea, allowing the platform to exert tension in the cable assembly while assuring that the platform does not exert compressive forces thereof.

2. The method according to claim 1 wherein a further step is accomplished that of withdrawing sea water from inside the tubular assembly.

3. A mooring cable assembly for securing a platform at sea, said cable assembly comprising;

elongated tubular assembly of constant cross-sectional size throughout its length, cable connector components at opposite ends said tubular assembly, fibrous tensile elements extending the full length of said tubular assembly and having end portions secured to said cable connector components, guide means for said tensile elements and including longitudinally spaced devices laterally spacing said fibrous tensile elements in circumaxial equidistant relationship to one another inside said tubular assembly, said tubular assembly adapted to absorb compressive stresses as said tension elements are tensioned, said connector components exerting tension on said compressibly prestressed tubular assembly but said cable connector components being incapable of exerting tension forces on the mooring cable assembly, said guide means further including an elongated support provided generally centrally of said tubular assembly, and wherein said longitudinally spaced devices comprise disks secured to said elongated support, said elongated support being segmented so as to remain unstressed during use of the structure.

4. The combination of claim 3 wherein said fibrous tensile elements have a breaking strength which is greater than that of steel.

5. The combination of claim 4 wherein the fibrous tensile elements are fabricated from an inorganic material.

6. The combination of claim 4 further characterized by providing a resin material around said tensile elements.

7. The combination according to claim 3 wherein said longitudinally spaced devices comprise laterally spaced discs with openings for receiving said fibrous tensile elements, and with openings for facilitating the withdrawal of water from inside said tubular assembly after installation of the structure at sea.

8. The combination according to claim 7 wherein said tubular assembly displaces an amount of sea water equivalent to its own weight.

* * * * *